US009025982B2

(12) United States Patent
Kameda

(10) Patent No.: US 9,025,982 B2
(45) Date of Patent: May 5, 2015

(54) IMAGE HEATING APPARATUS AND IMAGE FORMING APPARATUS HAVING PLURALITY OF IMAGE FORMING OR CONVEYING MODES CORRESPONDING TO THE GRAIN DIRECTION OF A SHEET

(71) Applicant: Canon Kabushiki Kaisha, Tokyo (JP)

(72) Inventor: Seiichiro Kameda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 13/943,034

(22) Filed: Jul. 16, 2013

(65) Prior Publication Data

US 2014/0029967 A1 Jan. 30, 2014

(30) Foreign Application Priority Data

Jul. 25, 2012 (JP) ..... 2012-164729

(51) Int. Cl.
*G03G 15/20* (2006.01)

(52) U.S. Cl.
CPC ..... *G03G 15/2085* (2013.01); *G03G 15/2046* (2013.01); *G03G 15/2028* (2013.01)

(58) Field of Classification Search
USPC ..... 399/45, 67–69, 320
See application file for complete search history.

(56) References Cited

U.S. PATENT DOCUMENTS

| | | | | |
|---|---|---|---|---|
| 4,890,140 | A * | 12/1989 | Negoro et al. | 399/322 |
| 5,130,754 | A | 7/1992 | Hishikawa | |
| 6,687,468 | B2 * | 2/2004 | Holubek et al. | 399/45 |
| 6,819,890 | B1 * | 11/2004 | Bott et al. | 399/67 |
| 6,882,804 | B2 * | 4/2005 | Eskey | 399/45 |
| 7,039,332 | B2 * | 5/2006 | Suzuki | 399/45 |
| 7,251,425 | B2 | 7/2007 | Kameda | |
| 7,477,858 | B2 * | 1/2009 | Fujii et al. | 399/67 |
| 7,653,321 | B2 * | 1/2010 | Yoshikawa | 399/67 |
| 7,890,024 | B2 | 2/2011 | Hirayama et al. | |
| 7,890,038 | B2 | 2/2011 | Chikugo et al. | |
| 7,962,080 | B2 | 6/2011 | Kameda | |
| 8,068,777 | B2 | 11/2011 | Kameda | |
| 8,417,150 | B2 | 4/2013 | Kameda | |
| 8,666,270 | B2 * | 3/2014 | Kubota et al. | 399/44 |
| 2008/0232834 | A1 * | 9/2008 | Tsukamura et al. | 399/45 |
| 2009/0052955 | A1 * | 2/2009 | Tatematsu et al. | 399/329 |
| 2010/0111579 | A1 * | 5/2010 | Condello et al. | 399/329 |
| 2010/0226700 | A1 * | 9/2010 | Yamada et al. | 399/329 |

FOREIGN PATENT DOCUMENTS

| | | | |
|---|---|---|---|
| JP | 2-262684 | A | 10/1990 |
| JP | 9-179435 | A | 7/1997 |
| JP | 2012242625 | A * | 12/2012 |

* cited by examiner

*Primary Examiner* — G. M. Hyder
(74) *Attorney, Agent, or Firm* — Fitzpatrick, Cella, Harper & Scinto

(57) ABSTRACT

An image heating apparatus includes a control unit that executes a long grain feed mode of conveying a long grain recording sheet whose grain direction is in parallel with a conveying direction of the recording sheet and a short grain feed mode of conveying a short grain recording sheet whose grain direction is orthogonal to the conveying direction of the recording sheet, the control unit changing, in accordance to the long grain feed mode and the short grain feed mode, temperature of a first rotating body set by the heating unit and setting of at least either one changeable setting among settings of a pressure-contact mechanism and a driving mechanism configured such that the setting of at least one of them is changeable.

20 Claims, 12 Drawing Sheets

IMAGE HEATING APPARATUS AND IMAGE FORMING APPARATUS HAVING PLURALITY OF IMAGE FORMING OR CONVEYING MODES CORRESPONDING TO THE GRAIN DIRECTION OF A SHEET

BACKGROUND OF THE INVENTION

1. Field of the Invention

The present invention relates an image heating apparatus configured to heat an image formed on a recording sheet.

2. Description of the Related Art

There has been known a configuration adopting an electrophotographic or electrostatic recording method for an image forming apparatus configured to form an image on a recording sheet such as a cut sheet cut into a predetermined size. Such image forming apparatus is configured to form a toner image on a recording sheet by an image forming portion and to fix the toner image on the recording sheet by a fixing apparatus, i.e., an image heating apparatus. Glossiness of an image is often adjusted by passing a recording sheet on which an image has been formed through the fixing apparatus.

That is, the fixing apparatus of this type fixes the toner image on the recording sheet by rotating a fixing roller and a pressure roller in pressure contact with each other and by passing the recording sheet on which the non-fixed toner image has been formed through a nip portion formed by the fixing roller and the pressure roller whose temperatures are kept at predetermined temperatures. Still further, in order to prevent wrinkles of the recording sheet that are otherwise prone to be generated in passing through the nip portion, there is known a configuration in which at least one of the fixing roller and the pressure roller is formed into a so-called an 'inverted crown' shape such that outer diameters at both ends in a longitudinal direction thereof are maximized and an outer diameter of a center portion thereof is minimized.

However, this configuration forcibly stretches the recording sheet in the longitudinal direction of the fixing roller and others. Accordingly, when a limp recording sheet such as a thin sheet is passed through the nip portion, the strain exerts on both ends of the recording sheet, so that the both ends of the recording sheet undulate, causing a so-call "waviness" and degrading quality of the recording sheet.

Then, Japanese Patent Application Laid-open No. H2-262684 has proposed a configuration of giving firmness on both end portions of a recording sheet by positioning a maximum outer diameter portion of a pressure roller configured into the inverted crown shape at an inner part, rather than both end portions thereof, to form a slight line on part of the recording sheet that comes into contact with the maximum outer diameter portion of the pressure roller.

Japanese Patent Application Laid-open No. H9-179435 has proposed a configuration of counting a number of recording sheets fed through a fixing apparatus and of reducing a pressurizing force of a pressure roller applied to a fixing roller corresponding to a counted value. That is, when the recording sheets pass successively through a nip portion between the fixing roller and the pressure roller, diameters of the fixing roller and the pressure roller vary in a longitudinal direction thereof due to an increase of temperature of non-sheet fed part(s) of the nip portion where the recording sheets do not contact in passing through the nip portion, so that a drum effect of varying distribution of pressure of the nip portion increases. In this case, it is possible to relax the drum effect and to keep the distribution of the pressure of the nip portion in an adequate condition by reducing the pressure as described above. As a result, it is possible to prevent the waviness of the recording sheet and to smoothly convey the recording sheet.

Lately, the image forming apparatus is digitized more and more and is made possible to form an image by processing a large amount of information. Also a need of variable printing of outputting information of each user on printed publications is increasing. Then, when the image forming apparatus is used as a variable printing machine, the same level of quality of sheets with that of a printing machine is naturally requested, so that it is required to improve quality of sheets of products of the image forming apparatus more than ever before.

Here, the sheet, i.e., the recording sheet, has grain of fibers in making the sheet of paper. The recording sheet has such a nature that tensile strength thereof is strong in a direction of the grain and is weak in a direction orthogonal to the direction of the grain. Accordingly, when a conveying direction of the recording sheet conveyed through the nip portion of the fixing apparatus is in parallel with the direction of the grain (long grain direction), the recording sheet is prone to deflect in a direction orthogonal to the conveying direction, so that sheet wrinkles are prone to be generated. Meanwhile, when the conveying direction of the recording sheet is orthogonal to the direction of the grain (short grain direction), the recording sheet is prone to deflect in a direction in parallel with the conveying direction, so that waviness is prone to be generated.

Meanwhile, it is a general practice in the field of the variable printing to print materials by determining grain of sheets beforehand depending on what kind of products is to be produced. That is, when a book is to be made by two-folding large size sheets, short grain sheets are used so that the sheets are hardly torn when pages of the sheets are turned for example. When a sheet, e.g., a poster, is not folded, a long grain sheet is used so that the sheet is hardly rounded.

It is then difficult to obtain such products that fully accommodate to user's desire by the abovementioned configurations described in Japanese Patent Application Laid-open Nos. H2-262684 and H9-179435. That is, desired products may not be obtained if a fixing condition of the fixing apparatus is uniformed regardless of grains of sheets and of types of products to be produced.

SUMMARY OF THE INVENTION

According to a first aspect of the invention, an image heating apparatus includes first and second rotational bodies that form a nip portion while being in pressure contact with each other, a heating unit that heats the first rotating body to heat an image formed on a recording sheet of paper conveyed to the nip portion, a pressure-contact mechanism that makes the first and second rotational bodies come in pressure contact to form the nip portion, a temperature sensor that detects temperature of the first rotating body, a driving mechanism that rotationally drives either one rotating body among the first and second rotational bodies, and a control unit that executes a long grain feed mode of conveying a long grain recording sheet whose grain direction is in parallel with a conveying direction of the recording sheet and a short grain feed mode of conveying a short grain recording sheet whose grain direction is orthogonal to the conveying direction of the recording sheet, the control unit changing, in accordance to the long grain feed mode and the short grain feed mode, temperature of the first rotating body set by the heating unit and setting of at least either one changeable setting among settings of the pressure-contact mechanism and the driving mechanism configured such that the setting of at least one of them is changeable.

According to a second aspect of the invention, an image heating apparatus of the invention includes first and second rotational bodies that form a nip portion while being in pressure contact with each other, a heating unit that heats the first rotating body to heat an image formed on a recording sheet conveyed to the nip portion, a pressure-contact mechanism that makes the first and second rotational bodies come in pressure contact and that can change a nip width in a recording sheet conveying direction of the nip portion by changing a pressure-contact force, a temperature sensor that detects temperature of the first rotating body, and a control unit that executes two or more modes in which the nip widths and the temperatures of the first rotating body are differentiated, respectively, and in which fixability of an image fixed on a recording sheet is assured within a predetermined range by controlling the pressure-contact mechanism and the heating unit.

According to a third aspect of the invention, an image heating apparatus of the invention includes first and second rotational bodies that form a nip portion while being in pressure contact with each other, a heating unit that heats the first rotating body to heat an image formed on a recording sheet conveyed to the nip portion, a driving mechanism that rotationally drives either one rotating body among the first and second rotational bodies and that changes conveying speed for conveying the recording sheet in the nip portion by changing rotational speed of the rotating body, a temperature sensor that detects temperature of the first rotating body, and a control unit that can execute two or more modes in which the conveying speeds and the temperatures of the first rotating body are differentiated, respectively, from each other and in which fixability of an image fixed on a recording sheet is assured within a predetermined range by controlling the driving mechanism and the heating unit.

Further features of the present invention will become apparent from the following description of exemplary embodiments with reference to the attached drawings.

DESCRIPTION OF THE EMBODIMENTS

First Embodiment

An image forming apparatus of a first embodiment of the invention will be described with reference to FIGS. 1 through 10. At first, a schematic structure of the image forming apparatus of the present embodiment will be described with reference to FIG. 1.

[Image Forming Apparatus]

Figure 1:
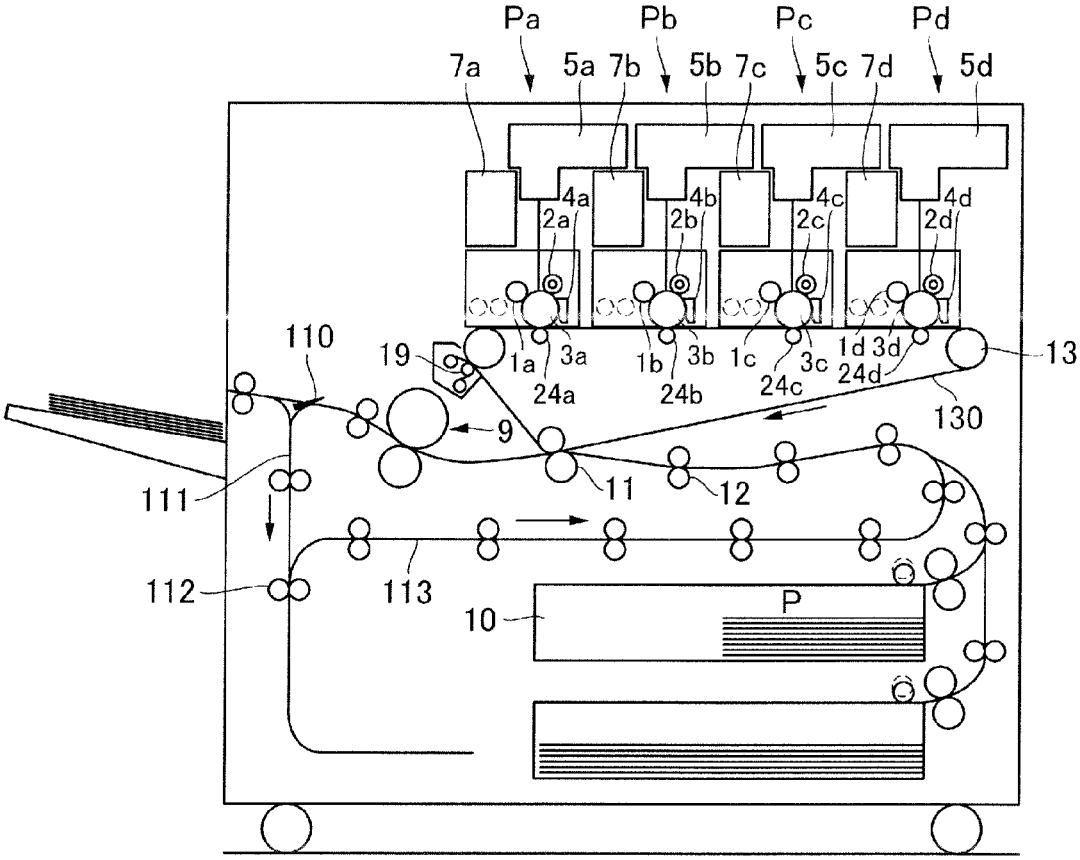
FIG. 1 is a schematic section view showing a configuration of an image forming apparatus of a first embodiment of the invention.

First, second, third and fourth image forming portions Pa, Pb, Pc and Pd are provided in tandem within the apparatus shown in FIG. 1 to form toner images of each different color through processes of forming latent images, development and transfer. The image forming portions Pa, Pb, Pc and Pd include photoconductive drums (electro-photographic photoreceptor) 3*a*, 3*b*, 3*c* and 3*d*, respectively, as each own image carrier, and the toner images of the respective colors are formed on the respective photoconductive drums 3*a*, 3*b*, 3*c* and 3*d*. Provided adjacent the respective photoconductive drums 3*a*, 3*b*, 3*c* and 3*d* is an intermediate transfer belt 130 as an intermediate transfer body. The toner images of the respective colors formed on the photoconductive drums 3*a*, 3*b*, 3*c* and 3*d* are primarily transferred on the intermediate transfer belt 130 and are transferred on a recording sheet of paper P in a secondary transfer portion. The recording sheet P on which the toner images are transferred is conveyed to a fixing apparatus 9, i.e., an image heating apparatus, that applies heat and pressure to the recording sheet P to fix the toner images, and is then discharged out of the apparatus as a recording sheet on which the image has been formed.

Provided around the photoconductive drums 3*a*, 3*b*, 3*c* and 3*d* are drum charging units 2*a*, 2*b*, 2*c* and 2*d*, developing units 1*a*, 1*b*, 1*c* and 1*d*, primary transfer charging units 24*a*, 24*b*, 24*c* and 24*d*, and cleaners 4*a*, 4*b*, 4*c* and 4*d*. Exposure units 5*a*, 5*b*, 5*c* and 5*d* that include laser emitting light source units, polygon mirrors and others, respectively, are provided at upper parts of the apparatus.

The drum charging units 2*a*, 2*b*, 2*c* and 2*d* charge surfaces of the photoconductive drums 3*a*, 3*b*, 3*c* and 3*d* to predetermined potentials, respectively. The exposure units 5*a*, 5*b*, 5*c* and 5*d* expose the photoconductive drums 3*a*, 3*b*, 3*c* and 3*d* by scanning the laser lights emitted from the light source units by turning the polygon mirrors, by deflecting refluxes of the scan lights by refection mirrors and by collecting the lights on generating lines of the photoconductive drums 3*a*, 3*b*, 3*c* and 3*d* by fθ lenses, respectively. Thereby, latent images corresponding to image signals are formed on the photoconductive drums 3*a*, 3*b*, 3*c* and 3*d* whose surfaces are charged with the predetermined potentials.

Predetermined amounts of yellow, magenta, cyan and black toners are filled in the developing units 1*a*, 1*b*, 1*c* and 1*d* as developing agents from supplying units 7*a*, 7*b*, 7*c* and 7*d*. The developing units 1*a*, 1*b*, 1*c* and 1*d* develop the latent images formed on the respective photoconductive drums 3*a*, 3*b*, 3*c* and 3*d* and visualize as a yellow toner image, a magenta toner image, a cyan toner image, and a black toner image, respectively.

The intermediate transfer belt 130 is rotationally driven by a drive roller 13 in a direction of an arrow with equal peripheral velocity with the photoconductive drums 3*a*, 3*b*, 3*c* and 3*d*. The yellow toner image formed and carried on the photoconductive drum 3*a* is primarily transferred on an outer circumferential surface of the intermediate transfer belt 130 in a process of passing through a nip portion (primary transfer portion) between the photoconductive drum 3*a* and the intermediate transfer belt 130. At this time, the toner image is transferred on the outer circumferential surface of the intermediate transfer belt 130 by an electric field and pressure generated by a primary transfer bias applied to the primary transfer charging unit 24*a*.

The magenta toner image, the cyan toner image, and the black toner image are sequentially transferred and superimposed on the intermediate transfer belt 130 in the same manner, and a composite color toner image corresponding to a target color image is formed on the intermediate transfer belt 130. Residual toners on the photoconductive drums 3*a*, 3*b*, 3*c* and 3*d* left after the primary transfer are removed and cleaned by the respective cleaners 4*a*, 4*b*, 4*c* and 4*d* to be used in a succeeding process of forming latent images.

A secondary transfer roller 11 is disposed in contact with the intermediate transfer belt 130. A desirable secondary transfer bias voltage is applied to the secondary transfer roller 11 by a secondary transfer bias power source. The composite color toner image transferred and superimposed on the intermediate transfer belt 130 is transferred on the recording sheet P conveyed to the secondary transfer portion as follows. That is, the recording sheet P is fed to the contact nip (secondary transfer portion) between the intermediate transfer belt 130 and the secondary transfer roller 11 from a sheet feeding cassette 10 through registration rollers 12 and pre-transfer guides at predetermined timing. The abovementioned composite color toner image is conveyed to the secondary transfer portion with this timing and in the same time, the secondary transfer bias voltage is applied from the bias power source to the secondary transfer roller 11. The composite color toner image is then transferred from the intermediate transfer belt 130 to the recording sheet P by the secondary transfer bias voltage.

Toners and other foreign matters on the intermediate transfer belt 130 left after the second transfer are wiped out by making a cleaning web (non-woven fabrics) 19 in contact with the surface of the intermediate transfer belt 130. The recording sheet P on which the toner image has been transferred is guided to the fixing apparatus 9 to fix the toner image by applying heat and pressure to the recording sheet P.

When a mode of the image forming apparatus is a duplex mode of forming images on both surfaces of the recording sheet P, the recording sheet P on one surface of which the image has been fixed by the fixing apparatus 9 is guided to an inverting path 111 by a change-over member 110. After that, the recording sheet P is reversed by a reversing roller 112 and is led to a duplex path 113. Then, the recording sheet P passes through the registration rollers 12, the pre-transfer guide, and the secondary transfer portion, and a toner image is formed on the back surface of the recording sheet P. The toner image is then fixed by the fixing apparatus 9. Thereby, the images are formed on the both surfaces of the recording sheet P. The change-over member 110 is changed over during when the image on the back surface of the recording sheet P is formed, so that the recording sheet P on the both surfaces of which the images have been fixed are then discharged out of the apparatus as the recording sheet P on which the images have been formed.

[Fixing Apparatus]

Next, a structure of the fixing apparatus 9, i.e., the image heating apparatus, of the present embodiment will be described first with reference to FIG. 2. The fixing apparatus 9 includes a fixing roller 40, i.e., a first rotating body, and a pressure roller 41, i.e., a second rotating body, that form a nip portion N in a condition of being in press contact with each other. The fixing roller 40 is provided with a halogen heater 40*a*, i.e., a heating unit, that heats the fixing roller 40 to heat an image formed on a recording sheet that is conveyed to the nip portion N. The pressure roller 41 is also provided with a halogen heater 41*a*, i.e., a heating unit, therein.

The fixing roller 40 is provided with an elastic layer around a metallic core and with a releasing layer formed on a surface of the elastic layer. For instance, silicon rubber of 2.0 mm thick having rubber hardness of 20° (JIS-A 1 kg weight) is molded as the elastic layer on the hollow core metal made of aluminum alloy of ϕ66 mm in outer diameter, and a fluorine resin releasing layer of 50 μm thick is coated on the surface of the elastic layer. An outer diameter of the entire roller is 70 mm. The releasing layer is a fluorine resin tube. In general, the fluorine tube is made of PFA resin (copolymer of tetrafluoro ethylene resin and perfluoroalkoxy ethylene resin), PTFE (tetrafluoro ethylene resin), or the like.

The pressure roller 41 is also provided with an elastic layer around a metallic core and with a releasing layer formed on a surface of the elastic layer in the same manner with the fixing roller 40. For instance, silicon rubber of 2.0 mm thick having rubber hardness of 20° (JIS-A 1 kg weight) is molded as the elastic layer on the hollow core metal made of aluminum alloy of ϕ66 mm in outer diameter, and a fluorine resin releasing layer of 50 μm thick is coated on the surface of the elastic layer. An outer diameter of the entire roller is 70 mm. Releasability to the toners is enhanced further by combining the fixing roller 40 and the pressure roller 41 having such configurations.

The fixing roller 40 is rotationally driven by a motor M, i.e., a driving source. That is, rotational driving force of the motor M is transmitted to a drive input gear 44 provided at one end of the fixing roller 40 so that the fixing roller 40 rotates at predetermined speed. The pressure roller 41 rotates following the fixing roller 40. Then, the fixing roller 40 and the pressure roller 41 convey a recording sheet while nipping a recording sheet at the nip portion between the fixing roller 40 and the pressure roller 41. Conveying speed of the recording sheet to be conveyed by the nip portion is set to be 700 mm/sec. in the present embodiment. It is noted that the fixing apparatus 9 may be configured such that the pressure roller 41 is driven. In short, either one rotating body among the fixing roller 40 and the pressure roller 41 is rotationally driven so that the recording sheet can be conveyed by the nip portion.

An end of a shaft of the pressure roller 41 is supported by an upper pressure lever 30. One end of the upper pressure lever 30 is rotatably supported by a shaft 31 fixed to a machine frame of the fixing apparatus 9. One end of a lower pressure lever 32 is also rotatably supported by the shaft 31 in the same manner. A compression spring 33 is disposed between another end of the upper pressure lever 30 and another end of the lower pressure lever 32. A release pin 34 is attached to the other ends of the upper pressure lever 30 and the lower pressure lever 32 to maintain a gap between the upper pressure lever 30 and the lower pressure lever 32 so that the upper pressure lever 30 and the lower pressure lever 32 are not separated from each other too much. The upper pressure lever 30, the shaft 31, the lower pressure lever 32, the compression spring 33 and the release pin 34 compose a pressure-contact mechanism 301 that causes the fixing roller 40 and the pressure roller 41 to be in pressure contact with each other.

Figure 3:
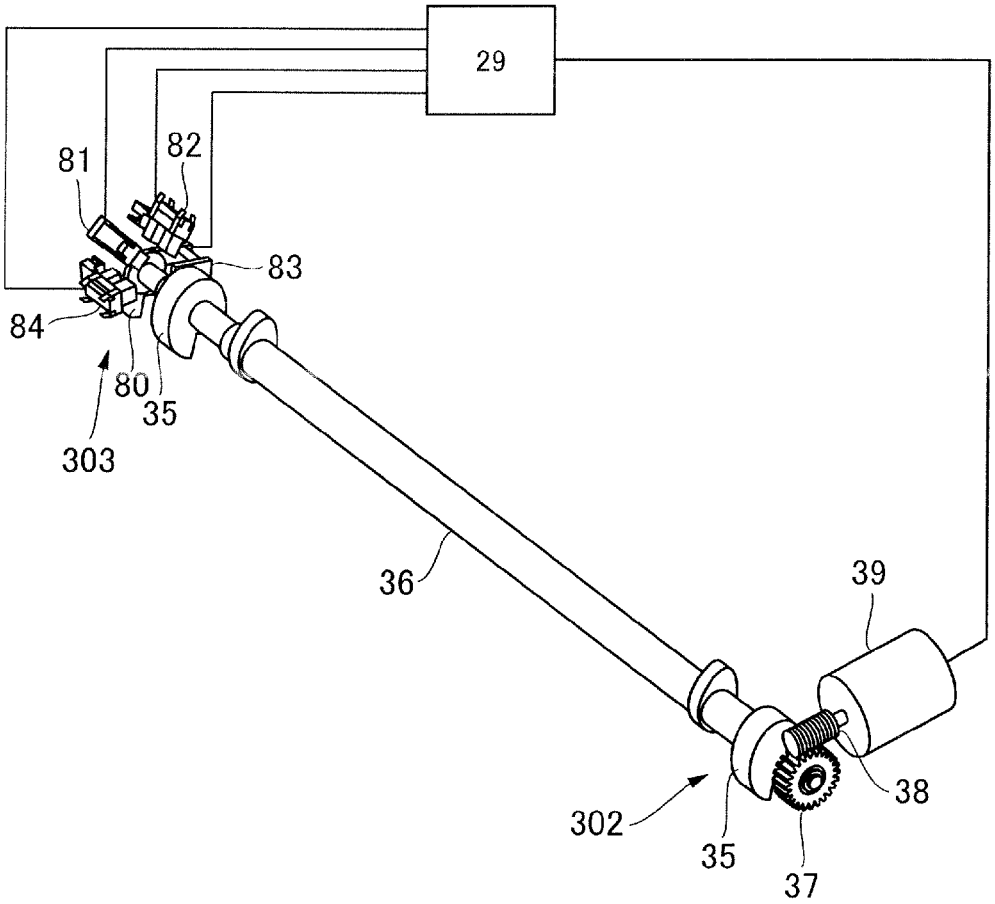
FIG. 3 is a perspective view showing a cam mechanism of the fixing apparatus.

The lower pressure lever 32 is provided with a pressure cam 35 below thereof. FIG. 3 shows an exemplary driving mechanism configured to drive the pressure cam 35. The pressure cam 35 is formed into a spiral shape such that distance of an outer circumference surface thereof from a center (eccentric position) varies depending on phase of the cam, and is fixed integrally with a rotary shaft 36 positioned at the eccentric position. The rotary shaft 36 is provided with a worm wheel 37 attached at an end portion thereof, and the worm wheel 37 is in mesh with a worm wheel 38. The worm wheel 38 is linked with a driving motor 39. Then, the rotary shaft 36 of the pressure cam 35 is rotationally driven by the driving motor 39 through the worm wheels 37 and 38. The pressure cam 35, the rotary shaft 36, the worm wheels 37 and 38 and the driving motor 39 compose a cam mechanism 302.

Thus, the pressure cam 35 turns as the rotary shaft 36 is rotationally driven by the driving motor 39. Still further, as shown in FIG. 2, the lower pressure lever 32 is provided with a roller 85 attached rotatably centering on a rotary shaft 86, and the pressure cam 35 pushes up the lower pressure lever 32 through the roller 85. The provision of the roller 85 reduces sliding resistance otherwise generated when the pressure cam 35 turns. This arrangement makes it possible to change the distance between the lower pressure lever 32 and the upper pressure lever 30 and to change a pressurizing force caused by the compression spring 33 by changing the phase of the pressure cam 35. As a result, it is also possible to change a pressure contact force that causes the pressure roller 41 to be in pressure contact with the fixing roller 40 through the upper pressure lever 30.

It is noted that the fixing roller 40 is separated from the pressure roller 41 during a standby time or the like. The gap between the upper pressure lever 30 and the lower pressure lever 32 is maintained by the release pin 34 so that the upper pressure lever 30 and the lower pressure lever 32 are not separated too much as described above. Due to that, when the pressure cam 35 turns and the lower pressure lever 32 drops, the upper pressure lever 30 also drops and making it possible to separate the fixing roller 40 from the pressure roller 41.

The rotary shaft 36 is provided with a sensor flag 80 attached at an end thereof so as to be able to detect the phase of the pressure cam 35 that passes through sensors 81, 82, 83 and 84. That is, the cam mechanism 400 makes it possible to change the pressure contact force (pressurizing force) between the fixing roller 40 and the pressure roller 41 by changing the phase of the pressure cam 35. It is also possible to change a nip width in a recording sheet conveying direction of the nip portion N by changing the pressure-contact force between the fixing roller 40 and the pressure roller 41 as described later.

The present embodiment is configured such that the nip width can be set to be a first nip width and to be a second nip width which is shorter than the first nip width, and the sensors 81 and 82 are disposed so as to be able to detect positions of the phases of the pressure cam 35 that cause the first and second nip widths, respectively. The sensor 83 detects position when the pressure roller 41 is separated from the fixing roller 40. The sensor 84 detects a home position of the pressure cam 35. A cam control portion 29 detects the phase of the pressure cam 35 by receiving signals from the respective sensors 81 through 84. Each of the sensors 81 through 84 has a light emitting portion and a light receiving portion that is disposed to face to the light emitting portion and receives light emitted from the light emitting portion, and detects the phase of the pressure cam 35 as the sensor flag 80 enters between the light emitting portion and the light receiving portion and the light is blocked. The sensor flag 80, the sensors 81 through 84 and the cam control portion 29 compose a phase detecting portion 303. According to the present embodiment, a pressure contact unit 300 includes the pressure-contact mechanism 301, the cam mechanism 302 and the phase detecting portion 303 described above.

The pressure-contact unit 300 constructed as described above makes it possible to set the nip width to be the first nip width and to be the second nip width which is shorter than the first nip width in the present embodiment. When the nip width is to be set at the first nip width, the pressure cam 35 is turned to the phase of a first pressurizing condition (in increasing pressure) in which the pressure-contact force of the pressure roller 41 to the fixing roller 40 increases. When the nip width is set to be set at the second nip width on the other hand, the pressure cam 35 is turned to the phase of a second pressurizing condition (in reducing pressure) in which the pressure-contact force of the pressure roller 41 to the fixing roller 40 decreases.

Figures 4A, 4B:
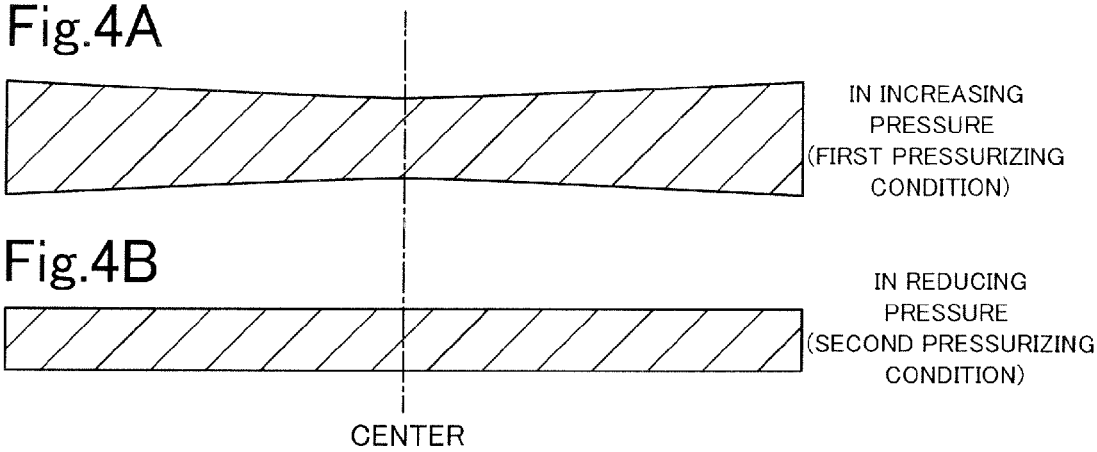
FIGS. 4A and 4B are schematic diagrams showing shapes of a nip portion when pressure is increased and decreased.

FIGS. 4A and 4B are schematic diagrams showing shapes of the nip portion N, i.e., distributions of pressure at the nip portion N between the pressure roller 41 and the fixing roller in the first and second pressurizing conditions. In the first pressurizing condition (in increasing pressure) shown in FIG. 4A, the distribution of pressure changes due to deflection of the rollers caused by the increase of the pressure-contact force, so that the drum effect increases. Then, the nip width at end portions in the longitudinal direction of the nip portion N (a direction of an axis of rotation of the fixing roller 40) increases as compared to the nip width at a center part in the longitudinal direction of the nip portion N, and a force of drawing (stretching) the recording sheet from the center part to the end portions increases.

Meanwhile, in the second pressurizing condition (in reducing pressure) shown in FIG. 4B, the drum effect decreases due to the reduction of the pressure-contact force, the nip width at the longitudinally center part of the nip portion N is almost equalized with the nip width of the end portions, and the force of drawing the recording sheet from the center part to the end portions decreases.

Accordingly, the nip width at the longitudinal center part of the nip portion N in the first pressurizing condition (in increasing pressure) is greater than that in the second pressurizing condition (in reducing pressure). That is, the first nip width set in the first pressurizing condition is greater than the second nip width set in the second pressurizing condition. This configuration makes it possible to control the force drawing the recording sheet from the center part to the both end portions by selectively switching between the first pressurizing condition (the first nip width) and the second pressurizing condition (second nip width).

Figure 2:
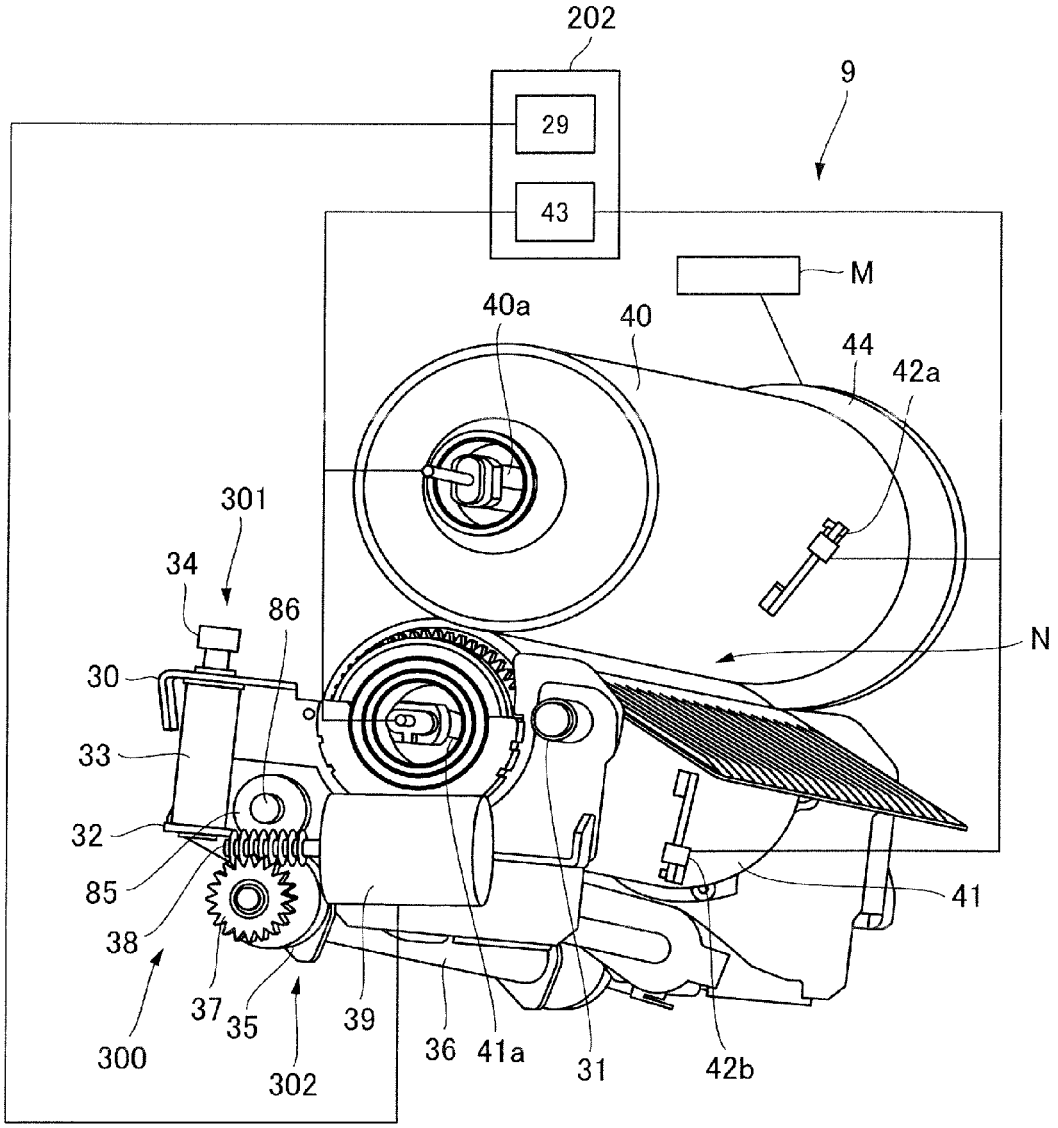
FIG. 2 is a perspective view showing a fixing apparatus of the first embodiment.

In the case of the present embodiment, the fixing and pressure rollers 40 and 41 are provided with thermistors 42*a* and 42*b*, i.e., temperature sensors that detect temperatures of the respective rollers, in contact with the rollers as shown in FIG. 2. A temperature control portion 43 controls halogen heaters 40*a* and 41*a* based on information on temperatures of the rollers 40 and 41 detected by the thermistors 42*a* and 42*b*. That is, the temperature control portion 43 controls the temperatures of the fixing and pressure rollers 40 and 41 to keep at target temperatures, so that the non-fixed image transferred on the recording sheet P is fixed on the recording sheet P by being heated and pressed in passing through the nip portion N.

The present embodiment is configured such that the temperature control portion 43 can set the target temperature of the fixing roller 40 at a first temperature and at a second temperature which is higher than the first temperature. The temperature of the pressure roller 41 is kept constant regardless of the preset temperature of the fixing roller 40. It is noted that the first temperature is lower than the second temperature.

Figure 5:
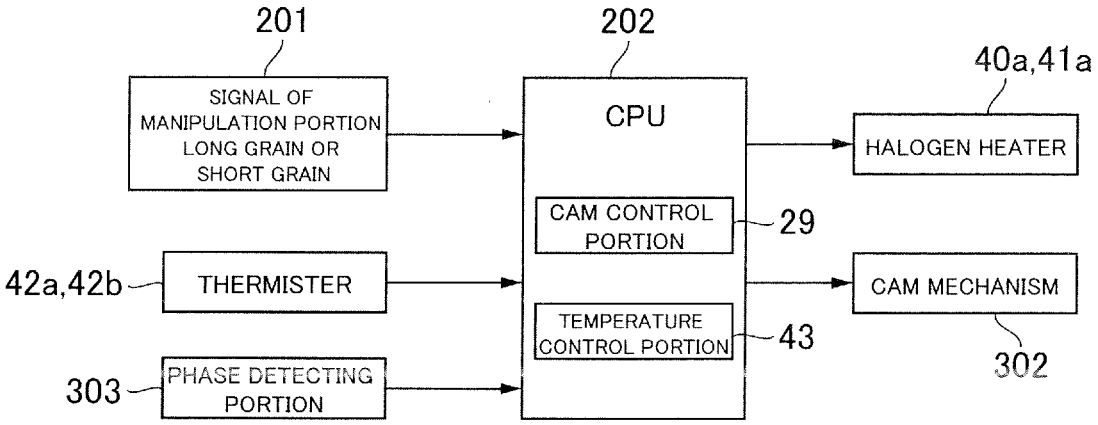
FIG. 5 is a control block diagram of the fixing apparatus of the first embodiment.

FIG. 5 is a control block diagram of the fixing apparatus 9 of the present embodiment. A control unit 202 having a microcomputer (CPU) includes the cam control portion 29 and the temperature control portion 43 described above. Manipulation signals input from a manipulation portion 201, the detected signals from the thermistors 42*a* and 42*b*, signals of the sensors 81 through 84 that detect the phase of the pressure cam 35 are input respectively to the control unit 202. Based on these signals, the control unit 202 controls the halogen heaters 40*a* and 41*a* and the cam mechanism 302.

Figure 6:
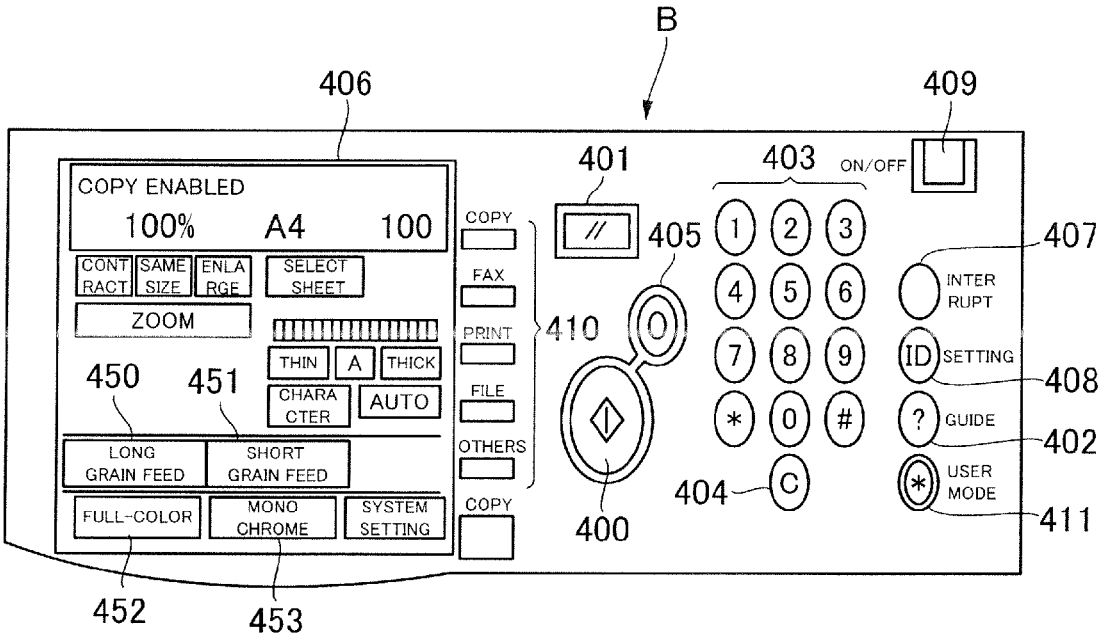
FIG. 6 is a schematic diagram showing a manipulation portion of the image forming apparatus.

The manipulation portion 201 has a manipulation display B as shown in FIG. 6. The display B includes a copy start key 400 for use in instructing to start to copy, and a reset key 401 for use in returning to a standard mode. The standard mode is set at forming an image in "Monochrome and One surface" in the present embodiment. The display B also includes a guidance key 402 that is pressed in using a guidance function, ten keys 403 for use in inputting a numerical value such as a number of sheets to be set, a clear key 404 for use in clearing a numerical value, a stop key 405 for use in stopping to copy during serial copy, a liquid crystal display and a touch panel 406 indicating setting of various modes and status of the printer, an interrupt key 407 for use in interrupting a current operation in use as serial copy, a facsimile or a printer to take a copy in urgent, password key 408 for use in managing a number of copies per individual or per section, a soft switch 409 for used in turning ON/OFF a power source of the body of the image forming apparatus, function keys 410 for use in changing functions of the image forming apparatus, and a user mode key 411 for use in entering a user mode in which such items as ON/OFF of auto-cassette change and change of a preset time until entering an energy saving mode are set in advance. By setting the user mode, setting buttons of the user mode can be displayed on the liquid crystal display 406.

In the case of the present embodiment, a long grain feed mode select key 450, a short grain feed mode select key 451, a full-color image forming mode select key 452, and a monochrome image forming mode select key 453 are set on the manipulation display B.

That is, the control unit 202 can execute two or more modes in the present embodiment. Specifically, the long grain feed mode and the short grain feed mode are modes that differentiate the nip widths of the nip portion N and temperature of the fixing roller 40 from each other and that permit to assure fixability of an image fixed on a recording sheet within a predetermined range. The predetermined range of the fixability is a range in which a difference between an upper limit and a lower limit of a rate of decrease of density is 5% or less, or preferably 3% or less in a scrubbing fixability test described later. That is, a condition of each mode is preset so that the fixability is substantially equalized in any modes. For instance, the condition of each mode is preset such that the rate of decrease of density is more than 5% and less than 7%.

Here, the long grain feed mode is a mode in which a recording sheet whose grain runs in the long grain direction in parallel with the conveying direction of the recording sheet is conveyed to the nip portion N. Meanwhile, the short grain feed mode is a mode in which a recording sheet whose grain runs in the short grain direction orthogonal to the conveying direction of the recording sheet is conveyed to the nip portion N. According to the present embodiment, the nip width is preset to the first nip width described above and temperature of the fixing roller 40 is preset at the first temperature described above in the long grain feed mode. Meanwhile, the nip width is preset to the second nip width described above and temperature of the fixing roller 40 is preset at the second temperature described above in the short grain feed mode.

In other words, the pressure-contact force of the pressure roller 41 to the fixing roller 40 is increased so that the nip width increases and the target temperature of the fixing roller 40 is set low so that fixing temperature is lowered in the long grain feed mode. In contrary to that, the pressure-contact force of the pressure roller 41 to the fixing roller 40 is reduced so that the nip width decreases and the target temperature of the fixing roller 40 is set high so that the fixing temperature increases in the short grain feed mode.

Figure 7:
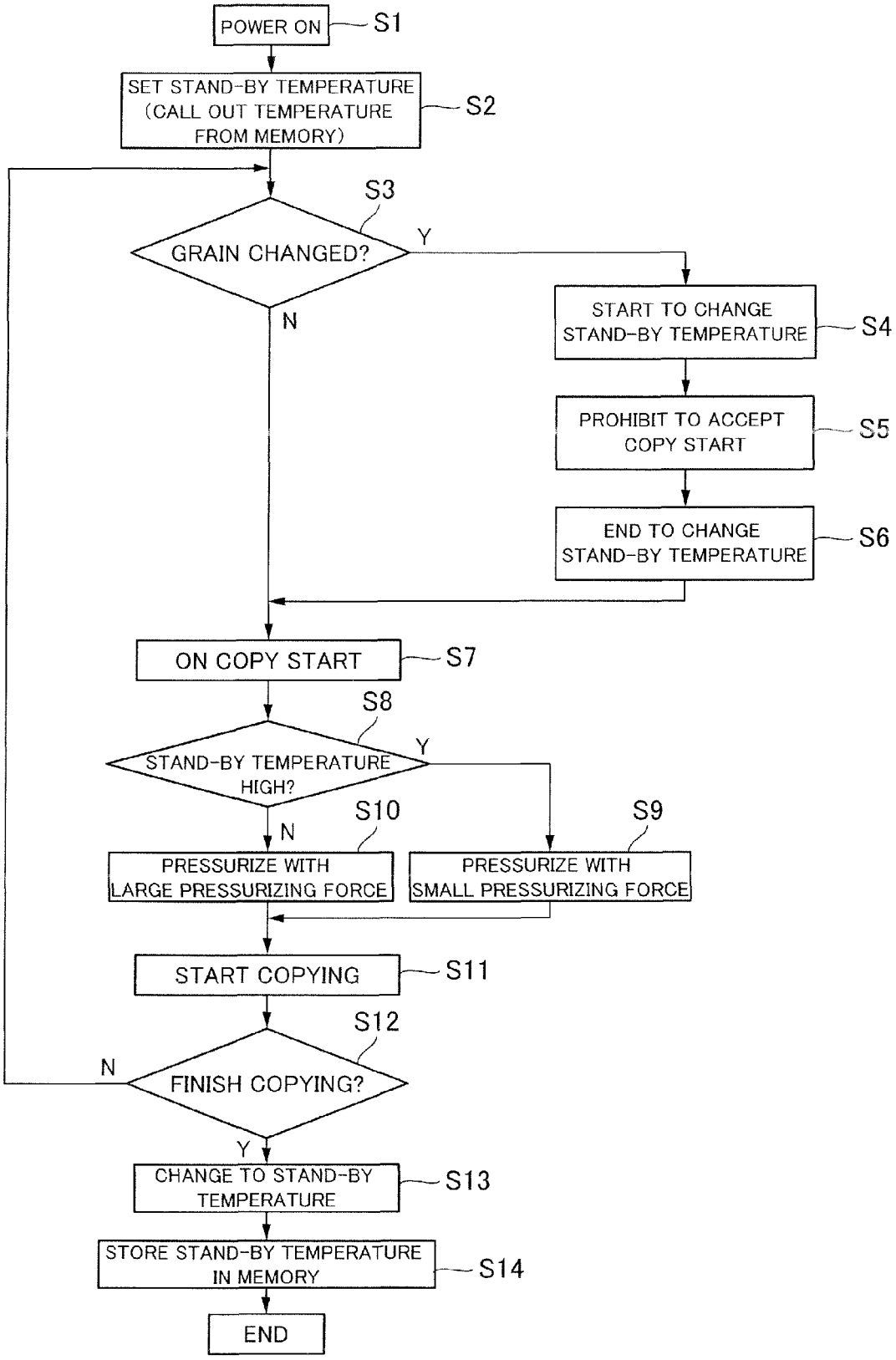
FIG. 7 is a flowchart showing a flow of controls of the fixing apparatus of the first embodiment.

FIG. 7 shows one exemplary flow of such control of the embodiment. Here, when the user presses the copy start key in FIG. 6 after pressing the long grain feed mode select key button 450, a fixing operation is carried out in the condition in which the pressure-contact force (pressurizing force) of the pressure roller 41 to the fixing roller 40 is large and the temperature of the fixing roller 40 is low. When the user presses the copy start key after pressing the short grain feed mode select key button 451 in the same manner, a fixing operation is carried out in the condition in which the pressurizing force is small and the temperature of the fixing roller 40 is high.

The fixing temperature during the stand-by time is set to be higher than stand-by temperature during copying by 10 degrees by considering a drop of temperature in starting copying. Then, when the long grain feed mode is selected, the fixing apparatus stands by at the stand-by temperature of the long grain feed mode, and when the selection is changed over to the short grain feed mode, the temperature is changed to the stand-by temperature of the short grain feed mode. The fixing apparatus is also configured to control such that when the Copy button is pressed during when the mode is changed over and the stand-by temperature is in midst of shift, the copying operation is started after completing the shift of the stand-by temperature.

Specifically, when the power source of the image forming apparatus is turned on in Step S1, the control unit 202 calls out stand-by temperature of a mode of that time from a memory to set the stand-by temperature in Step S2. Next, when the grain is changed from that in the previous job, i.e., Yes in Step S3, the stand-by temperature of the fixing apparatus 9 is started to be changed in Step S4. During this period, acceptance of Copy Start is prohibited in Step S5. Then, after finishing the change of the stand-by temperature in Step S6, the acceptance of Copy Start is started and when the copy start key 400 is pressed in Step S7, it is judged whether or not the stand-by temperature is high in Step S8. It is noted that when the grain is not changed in Step S3, i.e., No in Step S3, the control unit 202 advances to Step S7 as it is to start to accept Copy Start.

Here, when the stand-by temperature is high, i.e., Yes in Step S8, the pressure-contact force (pressurizing force) of the pressure roller 41 to the fixing roller 40 is set low because the short grain feed mode is selected in Step S9. When the stand-by temperature is low on the other hand, i.e., No in Step S8, the pressure-contact force (pressurizing force) of the pressure roller 41 to the fixing roller 40 is set high because the long grain feed mode is selected in Step S10. Then, copying is started in Step S11. The fixing temperature at this time is set to be lower than the fixing temperature during the stand-by time by 10 degrees.

When the copy end after that in Step S12, the temperature of the fixing apparatus 9 is changed to the temperature during the stand-by time (stand-by temperature) in Step S13, and the stand-by temperature is stored in a memory in Step S14 and finished the process. When copying is continued in Step S12, the process returns to Step S3.

In the case of the present embodiment, the control unit 202 differentiates the fixing conditions (setting of the heating unit and the pressure-contact mechanism in the case of the present embodiment) in the long grain feed mode and the short grain feed mode in accordance to the difference of physical properties of a recording sheet caused by the difference of grains of a sheet of paper as described above. This configuration allows a user to obtain desirable products by selecting a mode corresponding to the desire of the user. As described above, wrinkles are prone to be generated when the conveying direction in which the recording sheet is conveyed through the nip portion is in parallel with the long grain direction of the recording sheet because the recording sheet is prone to deflect in the direction orthogonal to the conveying direction. Meanwhile, the waviness is prone to be generated when the conveying direction of the recording sheet is in parallel with the short grain direction because the recording sheet is prone to deflect in a direction parallel with this conveying direction.

Figure 8:
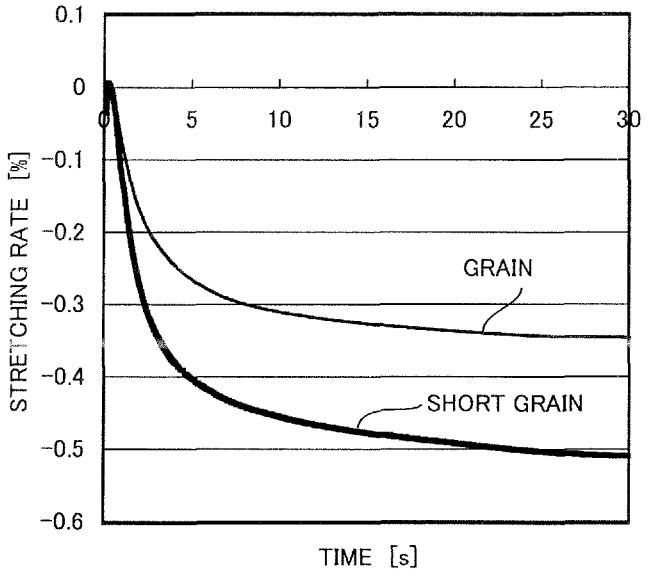
FIG. 8 is a graph showing an experimental result of ratios of expansion and contraction of a sheet respectively in a long grain direction and a short grain direction.

This point will be explained with reference to FIG. 8. FIG. 8 is a graph showing results of experiments carried out to study a difference of stretching degrees of a sheet of paper caused by directions of grains. The experiment was carried out to study the stretching degrees when 170 degrees of heat was applied to the sheet of paper of Canon CLC 80 (basis weight: 80 g/m$^2$, plain paper). An axis of abscissa of FIG. 8 represents an elapsed time (sec.), and an axis of ordinate represents a stretching rate.

The sheet of paper was a strip of 30 mm in width and 150 mm in length, and a load was applied in a tensile direction with a force of 300 gf in the longitudinal direction. Defining a direction in which the strip is stretched in a direction in parallel with grains of the sheet as a long grain direction, and a direction in which the strip is stretched in a direction orthogonal to the grains of the sheet is a short grain direction, the stretching rates in the both directions were studied in the experiment. An ambient temperature was 23° C. and humidity was 50%. It was then found from FIG. 8 that the sheet of paper has a property that it is hardly stretched in the long grain direction and is liable to be stretched in the short grain direction.

Stiffness caused by the grains of the sheet of paper was also measured by using Canon CLC 80 (basis weight: 80 g/m$^2$, plain paper). Gurley stiffness was measured in the environment of 23° C. of temperature and 50% of humidity. Measured values of Gurley stiffness were 1.58 mN in the long grain direction and 0.89 mN in the short grain direction. This result shows that a sheet of paper has a property that it is strong in the long grain direction and is weak in the short grain direction. It can be seen from the above result that, when a sheet of paper is fed through the fixing apparatus in heating and fixing a toner image on the sheet in the short grain direction, the sheet is prone to generate waviness because the sheet is prone to be stretched in the conveying direction and has not enough strength in the conveying direction. Meanwhile, it can be seen that, when the sheet is fed through the fixing apparatus in heating and fixing a toner image on the sheet in the long grain direction, the sheet is prone to generate wrinkles because the sheet is prone to be stretched in the longitudinal direction of the fixing roller and has not enough strength in the longitudinal direction.

Next, results of experiments carried out to measure wrinkle generating conditions and degrees of waviness will be explained. The experiment was carried out by differentiating control temperatures of the fixing roller 40 and pressure-contact forces (pressurizing force) of the pressure roller 41 to the fixing roller 40, respectively, per grain of the sheet. That is, a recording sheet is conveyed through the nip portion under the plurality of conditions in the long and short grain directions, respectively. The conditions were: pressurizing forces of 120 kgf (1.18 kN) and 150 kgf (1.47 kN), and temperatures of 200° C. and 170° C. Still further, the case when the pressurizing force of 150 kgf is applied was defined to be the case when the first nip width is formed, and the case when the pressurizing force of 120 kgf is applied was defined to be the case when the second nip width is formed. Still further, the temperature of 200° C. was defined to be the second temperature, and the temperature of 170° C. was defined to be the first temperature.

Here, the grain will be explained first. When fibers taken out of pulp flow through a machine in a papermaking process, the fibers are aligned in a direction of the flow in the machine. This flow of fibers is called as the grain. Then, a direction of the grain of the sheet in parallel (the same direction) to the conveying direction will be defined to be the long grain direction, and a direction of the grain orthogonal to the conveying direction will be defined to be the short grain direction.

The sheet of paper used in this experiment was Canon conveying speed 680 which is a plain paper whose basis weight is 68 g/m$^2$. Ambient temperature was 23° C. and humidity was 50%. The temperature of the pressure roller 41 was set at 140° C. in all of the conditions. The waviness of the sheet was measured by measuring a height of an apex of the waviness from a flat surface where the sheet was placed after fixation of a part of the sheet from which four corners were cut. A maximum value in one sheet was measured. Then, an average value of the maximum values of five sheets was defined as a waviness of the sheets. Regarding wrinkles generated on the sheet, a case in which even one sheet generates wrinkles is indicated by X, and a case in which none of the sheet generates wrinkles is indicated as O after printing 100 duplex sheets in the following Table 1 showing the results of this experiment:

TABLE 1

| No. | DIRECTION OF GRAIN OF SHEET WITH RESPECT TO CONVEYING DIRECTION | PRESSURIZING FORCE | TEMPERATURE OF FIXING ROLLER | WAVINESS OF SHEET (mm) | WRINCLES |
|---|---|---|---|---|---|
| 1 | LONG | 120 kgf (SMALL) | 200° C. (HIGH) | 1.8 | X |
| 2 | SHORT | 120 kgf (SMALL) | 200° C. (HIGH) | 2 | ○ |
| 3 | LONG | 150 kgf (LARGE) | 170° C. (LOW) | 2.1 | ○ |
| 4 | SHORT | 150 kgf (LARGE) | 170° C. (LOW) | 3.5 | ○ |

It is noted that conditions of the experiment Nos. 1 through 4 shown in Table 1 are set such that toner scrubbing fixability is equalized in all of the sheets. The scrubbing fixability is measured by comparing rates of decrease of density of a solid black portion by pressing and reciprocating a lens-cleaning paper of ϕ30 mm five times to sheets on which the solid black has been fixed. The rates of decrease of density were 5 to 7% in all of the experiment Nos. 1 through 4.

It was found from the results of the experiments described above that the conditions which reduce the wrinkles and waviness are conditions in which the pressurizing force is small and the temperature of the fixing roller is high in the short grain feed, and are conditions in which the pressurizing force is large and the temperature of the fixing roller is low in the long grain feed.

Regarding this phenomenon, it was found that toner melt conditions turn out as follows as a result of observation of outputs made by a laser microscope (Keyence Co., Ltd., VK 8000 series). The toner melt conditions will be explained below by using schematic diagrams.

Figure 9A:
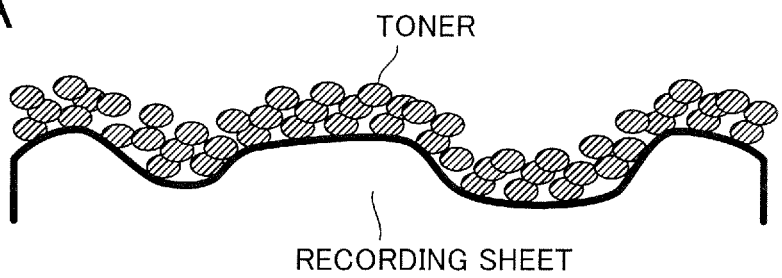
FIG. 9A is a schematic diagram showing toners in a non-fixed condition when a long grain feed mode is executed.
Figure 9B:
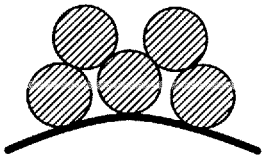
FIG. 9B is an enlarged view of FIG. 9A.
Figure 9C:
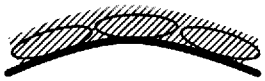
FIG. 9C is a schematic diagram showing a condition in which the toners melt when the long grain feed mode is executed.
Figure 9D:
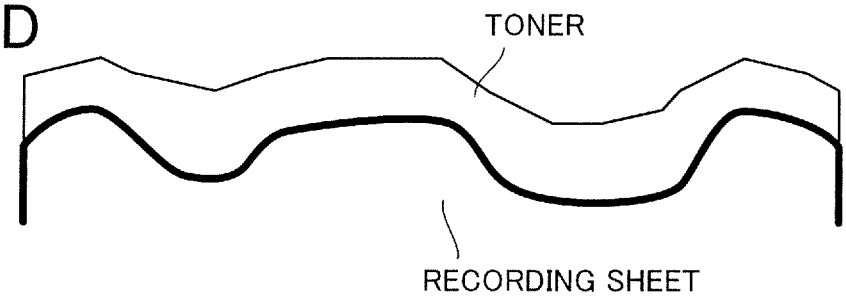
FIG. 9D is a schematic diagram showing a surface condition of the fixed toners when the long grain feed mode is executed.
Figure 10A:
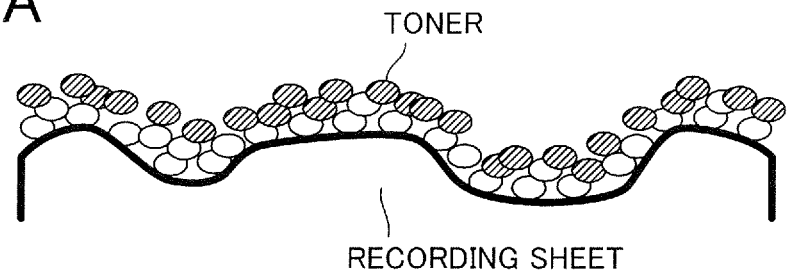
FIG. 10A is a schematic diagram showing toners in a non-fixed condition when a short grain feed mode is executed.
Figure 10B:
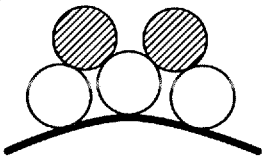
FIG. 10B is an enlarged view of FIG. 10A.
Figure 10C:
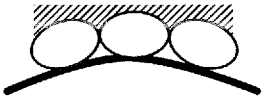
FIG. 10C is a schematic diagram showing a condition in which the toners melt when the short grain feed mode is executed.
Figure 10D:
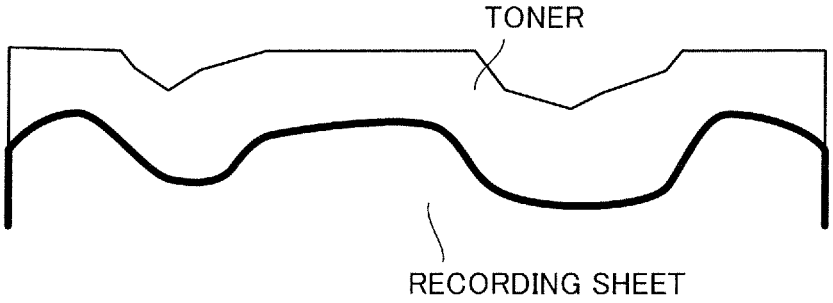
FIG. 10D is a schematic diagram showing a surface condition of the fixed toners when the short grain feed mode is executed.

FIG. 9A through 9D are schematic diagrams showing toner melting processes when the pressurizing force is large and the temperature of the fixing roller is low in the long grain feed, and FIG. 10A through 10D are schematic diagrams showing toner melting processes when the pressurizing force is small and the temperature of the fixing roller is high in the short grain feed. FIG. 9A shows a condition of non-fixed toners on a recording sheet, FIG. 9B is an enlarged view of FIG. 9A, FIG. 9C shows a condition in which the toners melt from the condition shown in FIG. 9B, and FIG. 9D shows a condition of a toner image surface on the recording sheet in which the non-fixed toners have been melt and fixed. FIG. 10A also shows a condition of non-fixed toners on a recording sheet, FIG. 10B is an enlarged view of FIG. 10A, FIG. 10C shows a condition in which the toners melt from the condition shown in FIG. 10B, and FIG. 10D shows a condition of a toner image surface on the recording sheet in which the non-fixed toners have been melt and fixed.

It was found that, when the pressurizing force is large and the temperature of the fixing roller is low in the long grain feed, the toners on upper and lower layer sides follow a surface of the recording sheet uniformly as shown in FIG. 9D. It is because the toners melt homogeneously and are fixed in a condition in which both the upper and lower layer side toners have received enough heat uniformly.

It was also found that, when the pressurizing force is small and the temperature of the fixing roller is high in the short grain feed, a surface condition of the fixing roller 40 is transferred on a surface of a toner layer as shown in FIG. 10D. It is because the toners on a lower layer do not melt and are hardly influenced by the surface condition of the recording sheet and only a top toner surface of the image surface has melted. That is, the toners have been fixed to the sheet in a condition in which heat is transmitted less to the sheet.

The heat is transmitted only to the surface of the toner in a condition in which the fixability is not changed if the pressurizing force is reduced and the fixing temperature is increased from the abovementioned condition. Due to that, the toner melt condition changes from the condition shown in FIG. 9D to the condition shown in FIG. 10D, and the waviness of the sheet drops because a quantity of heat applied to the sheet is reduced. Meanwhile, if the pressurizing force is reduced and the fixing temperature is increased, wrinkles are prone to be generated because the sheet is drawn less with respect to a stretch of the sheet.

Accordingly, the pressurizing force is reduced and the temperature of the fixing roller is increased as the conditions in the short grain feed because the sheet is otherwise prone to generate waviness by being stretched by heat in the conveying direction and hardly generates wrinkles because the stiffness of the sheet in the roller longitudinal direction is strong. This arrangement makes it possible to improve the quality of the sheet by reducing the quantity of heat applied to the sheet and by suppressing the waviness of the sheet.

Meanwhile, the pressurizing force is increased and the temperature of the fixing roller is lowered as the conditions in the long grain feed because the sheet hardly causes waviness by being stretched by heat in the conveying direction and is otherwise prone to generate wrinkles because the stiffness of the sheet in the roller longitudinal direction is weak. This arrangement makes it possible to improve the quality of the sheet by increasing the drawing force in the longitudinal direction of the fixing roller and by suppressing the wrinkles of the sheet.

The present embodiment allows the user to select the abovementioned conditions through the manipulation portion, and to select the case when the pressurizing force is large and the temperature of the fixing roller is low as the long grain feed mode and the case when the pressurizing force is small and the temperature of the fixing roller is high as the short grain feed mode. The embodiment configured as described above permits to obtain the abovementioned advantageous effects when a recording sheet whose basis weight is 105 $g/m^2$ or less or more preferably 80 $g/m^2$ or less is used.

The present embodiment is also configured to present optimal conditions concerning the physical properties of the long and short grains of a sheet and to be able to execute the long grain feed mode and the short grain feed mode. When the schematic diagrams (FIGS. 9A through 9D) showing the toner melting processes when the pressurizing force is large and the temperature of the fixing roller is low are compared with the schematic diagrams (FIGS. 10A through 10D) showing the toner melting processes when the pressurizing force is small and the temperature of the fixing roller is high, it can be seen that an anchor effect (adhesion) of the toners to the sheet is large because the toners melt homogeneously on the sheet when the pressurizing force is large and the fixing temperature is low (FIG. 9D), so that the toners adhere firmly to the sheet even at a bent portion where the sheet is folded.

It can be also seen that when the pressurizing force is small and the temperature of the fixing roller is high (FIG. 10D) on the other hand, the toners on the lower layer side are not melt and only the top toner surface of the image surface is melt, so that the toners are prone to be peeled off the sheet at a bent portion where the sheet is folded. However, the waviness of the sheet is generated less and the quality of the sheet is good because the toners are fixed to the sheet without applying heat so much to the sheet during fixation as described above.

Accordingly, it is also possible to arrange the mode selected by the user through the manipulation portion as a folding preceding mode when the pressurizing force is large and the temperature of the fixing roller is low, and as a product quality preceding mode when the pressurizing force is small and the temperature of the fixing roller is high. That is, it is possible to set the long grain feed mode described above as the product quality preceding mode and the short grain feed mode as the folding preceding mode. Here, the product quality preceding mode is a mode of preceding the quality of an image fixed on the recording sheet and the folding preceding mode is a mode of preceding foldability of the recording sheet on which an image has been fixed.

The modes may be separated so that the user can select either one of the folding preceding mode and the product quality preceding mode, or a standard mode may be provided between the folding preceding mode and the product quality preceding mode. In the standard mode, the pressurizing force is set at an intermediate value between those of the folding preceding mode and the product quality preceding mode, and the fixing control temperature is set at an intermediate value between those of the folding preceding mode and the product quality preceding mode.

Types of media increase and physical properties of sheets of paper vary in a machine using the image forming apparatus as a variable printing machine as compared to a case when the image forming apparatus is used in offices. The quality level of sheets is also required to be higher than that of the office machine and to be the same level with that of the printing machine. To that end, the image forming apparatus of the present embodiment allows the user to select the optimum pressurizing force and fixing temperature for each media and to obtain products whose sheet quality level is high as the user wishes.

Second Embodiment

Figure 11:
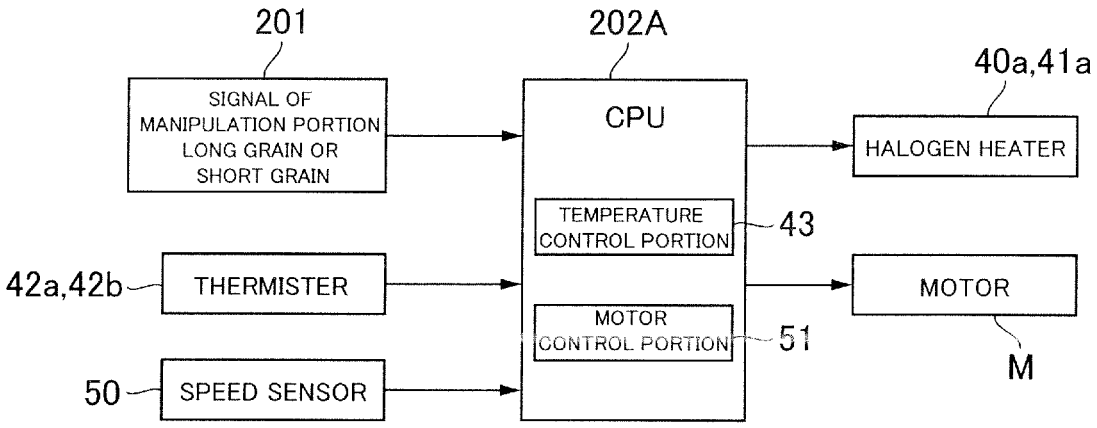
FIG. 11 is a control block diagram of a fixing apparatus of a second embodiment of the invention.

A second embodiment of the invention will be described by using FIG. 11 and with reference to FIG. 2. The pressure-contact force of the pressure roller 41 to the fixing roller 40 and the temperature of the fixing roller 40 are switched per mode in the first embodiment described above. In the present embodiment, however, speed for conveying a recording sheet in the nip portion is switched per mode, instead of the pressure-contact force of the pressure roller 41 to the fixing roller 40 in the first embodiment.

To that end, a fixing apparatus of the present embodiment includes a speed sensor 50 that detects rotational speed of the fixing roller 40, and a motor control portion 51 that controls a rotational speed of the motor M based on the detected result of the speed sensor 50. The speed sensor 50 is an encoder that detects a rotational speed of a rotary shaft of the fixing roller 40 for example. It is noted that the speed sensor may be configured to detect a rotational speed of the pressure roller 41 or to detect a rotational speed of a rotary shaft of the motor M. The speed sensor may be configured in any manner as long as it can detect the speed for conveying the recording sheet at the nip portion.

Specifically, the motor control portion 51 is installed as a part of functions of the control unit 202A, and is configured to be able to change the conveying speed for conveying a recording sheet at the nip portion N by changing the rotational speed of the motor M. Accordingly, the speed sensor 50, the motor control portion 51 the motor M and a power transmission route from the motor M to the fixing roller 40 correspond a driving mechanism.

Then, the control unit 202 is capable of executing two or more modes in which conveying speeds for conveying a recording sheet and temperatures of the fixing roller 40 are differentiated, respectively, and in which fixability of an image fixed on the recording sheet is assured within a predetermined range by controlling the driving mechanism and the temperature control portion 43. The control unit 202 of the present embodiment enables to set the conveying speed at a first conveying speed and at a second conveying speed which is faster than the first conveying speed, and to set the temperature of the fixing roller 40 at the first temperature and at the second temperature which is higher than the first temperature.

Then, the control unit 202 sets the conveying speed at the first conveying speed which is slower than the second conveying speed and sets the temperature of the fixing roller 40 at the first temperature in the long grain feed mode, and sets the conveying speed at the second conveying speed and sets the temperature of the fixing roller 40 at the second temperature in the short grain feed mode.

Next, results of experiments carried out to measure a wrinkle generating condition and a waviness of a sheet will be explained. The experiment was carried out by differentiating control temperatures of the fixing roller 40 and conveying speeds of the recording sheet at the nip portion per each grain of the sheet. That is, the recording sheet was conveyed through the nip portion in a plurality of conditions respectively in the long grain direction and the short grain direction. The conveying speeds were 800 mm/sec. and 500 mm/sec. as the conditions. The temperatures of the fixing roller 40 were 200° C. and 170° C. The case when the conveying speed is 800 mm/sec. was defined to be the second conveying speed, and the case when the conveying speed is 500 mm/sec. was defined to be the first conveying speed. Still further, the case when the temperature is 200° C. was defined to be the second temperature and the case when the temperature is 170° C. was defined to be the first temperature.

In the experiment, the pressure-contact force (pressurizing force) of the pressure roller 41 to the fixing roller 40 was set uniformly at 135 kgf (1.32 kN) in every case. The sheet of paper used in this experiment was Canon conveying speed680 which is a plain paper whose basis weight is 68 g/m$^2$. Ambient temperature was 23° C. and humidity was 50%. The temperature of the pressure roller 41 was set at 140° C. in all of the conditions. The waviness of the sheet was measured by measuring a height of an apex of the waviness from a flat surface where the sheet was placed after fixation of a part of the sheet from which four corners were cut. A maximum value in one sheet was measured. Then, an average value of the maximum values of five sheets was defined as a waviness of the sheets. Regarding wrinkles generated on the sheet, a case in which even one sheet generates wrinkles is indicated by X, and a case in which none of the sheet generates wrinkles is indicated as O after printing 100 duplex sheets in the following Table 2 showing the results of this experiment:

TABLE 2

| No. | DIRECTION OF GRAIN OF SHEET WITH RESPECT TO CONVEYING DIRECTION | SHEET CONVEYING SPEED | TEMPERATURE OF FIXING ROLLER | WAVINESS OF SHEET (mm) | WRINCLES |
|---|---|---|---|---|---|
| 5 | LONG | 800 mm/sec (FAST) | 200° C. (HIGH) | 1.9 | X |
| 6 | SHORT | 800 mm/sec (FAST) | 200° C. (HIGH) | 2.2 | ○ |
| 7 | LONG | 500 mm/sec (SLOW) | 170° C. (LOW) | 2.1 | ○ |
| 8 | SHORT | 500 mm/sec (SLOW) | 170° C. (LOW) | 3.8 | ○ |

It is noted that conditions of the experiment Nos. 5 through 8 shown in Table 2 are set such that toner scrubbing fixability is equalized in all of the sheets. The rates of decrease of density were set to be 5 to 7% also in the experiment Nos. 5 through 8 so that the conditions are equalized with those of the experiments in Table 1.

It was found from the results of the experiment described above that the conditions which reduce the wrinkles and waviness are conditions in which the conveying speed is fast and the temperature of the fixing roller is high in the short grain feed, and are conditions in which the conveying speed is slow and the temperature of the fixing roller is low in the long grain feed.

It was found from the above results that the same effects with the first embodiment can be obtained by variably setting the conveying speed, instead of the pressurizing force. Accordingly, in a configuration in which the fixing pressurizing force cannot be varied as a condition of the apparatus body, it is possible to obtain products whose quality level is high as required by the user by variably setting the conveying speed for conveying the recording sheet at the nip portion. The other configuration and effects are same with those of the first embodiment described above.

Third Embodiment

Figure 12:
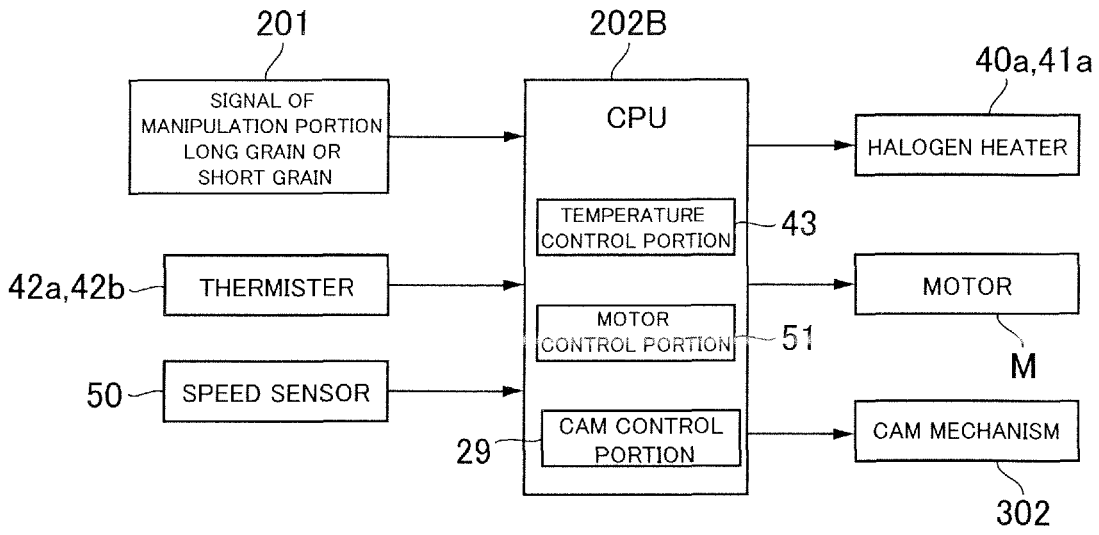
FIG. 12 is a control block diagram of a fixing apparatus of a third embodiment of the invention.

Each embodiment described above may be carried out by adequately combining them. For instance, a control unit 202B shown in FIG. 12 can set the conveying speed for conveying the recording sheet in the nip portion at the first conveying speed indicated in the second embodiment in the long grain feed mode and similarly at the second conveying speed in the short grain feed mode in the configuration of the first embodiment. That is, the control unit is configured to be able to change setting of the heating unit and at least either one setting of the pressure-contact mechanism and the driving mechanism, and may be configured in any manner as long as the control unit can change the temperature of the first rotating body set by the heating unit, and setting of at least one (pressure-contact force, conveying speed) of the pressure-contact mechanism and the driving mechanism configured such that its setting can be changed in accordance to the difference of physical properties of the recording sheet caused by the difference of grain directions.

The configurations that allow the two or three modes to be executed respectively for the long grain feed mode and the short grain feed mode, or the product quality preceding mode or the folding preceding mode have been explained in the embodiments described above. However, it is possible to set many more modes. For instance, it is possible to set a plurality of modes only in the long grain feed mode and to change parameters such as the nip width, the temperature of the fixing roller 40 and the conveying speed of the recording sheet in each mode. A plurality of modes may be set in the same manner also in the short grain feed mode. In this case, relationships of the parameters themselves between the long grain feed mode and the short grain feed mode may be set as described above. For instance, all of nip widths in the plurality of long grain feed modes are set to be greater than all of nip widths of the plurality of short grain feed modes. The same applies to the temperature of the fixing roller 40 and to the conveying speed of the recording sheet.

These plurality of modes may be set per every basis weight of a recording sheet, in addition to the long and short grains. For instance, when the basis weight is greater than 80 g/m$^2$ and less than 105 g/m$^2$, the short grain feed mode is set as follows. That is, a nip width is set at an intermediate value between the first and second nip widths or conveying speed is set at an intermediate value between the first and second conveying speeds, and the temperature of the fixing roller is set at an intermediate value between the first and second temperatures. At this time, while those values may be set in the same manner also in the long grain feed mode, the relationships of the parameters themselves between the long grain feed mode and the short grain feed mode are kept as described above. Still further, when the basis weight is 80 g/m$^2$ or less for example, the parameters are set as described in each embodiment described above. When the basis weight is greater than 105 g/m$^2$ for example, the nip width, the temperature of the fixing roller, and conveying speed are equalized in the long grain feed mode and the short grain feed mode.

Regarding the fixing roller 40 and the pressure roller 41, at least either one may be constructed by a belt. Still further, although the halogen heater was used as the heating unit in the embodiments described above, a heating unit using induction heating, e.g., an IH coil, may be used.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-164729, filed on Jul. 25, 2012, which is hereby incorporated by reference herein in its entirety.

What is claimed is:

1. An image heating apparatus, comprising:

first and second rotational bodies that form a nip portion while being in pressure contact with each other;

a heating unit that heats the first rotating body to heat an image formed on a recording sheet conveyed to the nip portion;

a pressure-contact mechanism that makes the first and second rotational bodies come in pressure contact to form the nip portion;

a temperature sensor that detects the temperature of the first rotating body;

a driving mechanism that rotationally drives either one of the rotating bodies among the first and second rotational bodies; and a control unit that executes a long grain feed mode of conveying a long grain recording sheet whose grain direction is in parallel with a conveying direction of the recording sheet and a short grain feed mode of conveying a short grain recording sheet whose grain direction is orthogonal to the conveying direction of the recording sheet, the control unit changing, in accordance to the long grain feed mode and the short grain feed mode, the temperature of the first rotating body set by the heating unit and setting of at least either one changeable setting among settings of the pressure-contact mechanism and the driving mechanism configured such that the setting of at least one of them is changeable.

2. The image heating apparatus according to claim 1, wherein the control unit controls the pressure-contact mechanism to set a nip width in the conveying direction of the recording sheet in the nip portion to be a first nip width and controls the heating unit to set the temperature of the first rotating body at a first temperature, which is lower than a second temperature in the long grain feed mode; and wherein the control unit controls the pressure-contact mechanism to set the nip width to be a second nip width, which is smaller than the first nip width, and controls the heating unit to set the temperature of the first rotating body at the second temperature in the short grain feed mode.

3. The image heating apparatus according to claim 2, wherein the control unit sets a conveying speed for conveying the recording sheet determined by the setting of the driving mechanism at a first conveying speed, which is slower than a second conveying speed, in the long grain feed mode and at the second conveying speed in the short grain feed mode, respectively.

4. The image heating apparatus according to claim 1, wherein the control unit controls the driving mechanism to set the conveying speed for conveying the recording sheet in the nip portion at a first conveying speed, which is slower than a second conveying speed, and controls the heating unit to set the temperature of the first rotating body at a first temperature, which is lower than a second temperature in the long grain feed mode; and the control unit controls the driving mechanism to set the conveying speed at the second conveying speed and controls the heating unit to set the temperature of the first rotating body at the second temperature in the short grain feed mode.

5. An image heating apparatus, comprising:

first and second rotational bodies that form a nip portion while being in pressure contact with each other;

a heating unit that heats the first rotating body to heat an image formed on a recording sheet conveyed to the nip portion;

a pressure-contact mechanism that makes the first and second rotational bodies come in pressure contact and that changes a nip width of the nip portion in a conveying direction of recording sheet by changing a pressure-contact force;

a temperature sensor that detects the temperature of the first rotating body; and a control unit that executes a long grain feed mode of conveying a long grain recording sheet whose grain direction is in parallel with a conveying direction of the recording sheet and a short grain feed mode of conveying a short grain recording sheet whose grain direction is orthogonal to the conveying direction of the recording sheet, wherein the control unit sets the nip width to be a first nip width and sets the temperature of the first rotating body at a first temperature, which is lower than a second temperature, in the long grain feed mode, and wherein the control unit sets the nip width to be a second nip width, which is smaller than the first nip width, and sets the temperature of the first rotating body at the second temperature in the short grain feed mode.

6. The image heating apparatus according to claim 5, further comprising a driving mechanism that rotationally drives either one rotating body among the first and second rotational bodies and that sets the conveying speed for conveying a recording sheet in the nip portion at a first conveying speed and at a second conveying speed, which is faster than the first conveying speed, by changing the rotational speed of the rotating body; and wherein the control unit sets the conveying speed at the first conveying speed in the long grain feed mode and at the second conveying speed in the short grain feed mode, respectively.

7. The image heating apparatus according to claim 5, wherein the control unit is configured to execute a product quality prioritizing mode of prioritizing the quality of an image fixed on a recording sheet and a folding prioritizing mode of prioritizing foldability of a recording sheet on which an image is fixed; and wherein the long grain feed mode is the product quality prioritizing mode, and the short grain feed mode is the folding prioritizing mode.

8. An image heating apparatus, comprising:

first and second rotational bodies that form a nip portion while being in pressure contact with each other;

a heating unit that heats the first rotating body to heat an image formed on a recording sheet conveyed to the nip portion;

a driving mechanism that rotationally drives either one rotating body among the first and second rotational bodies and that changes the conveying speed for conveying the recording sheet in the nip portion by changing the rotational speed of the rotating body;

a temperature sensor that detects the temperature of the first rotating body; and a control unit that executes a long grain feed mode of conveying a long grain recording sheet whose grain direction is in parallel with a conveying direction of the recording sheet and a short grain feed mode of conveying a short grain recording sheet whose grain direction is orthogonal to the conveying direction of the recording sheet, wherein the control unit sets the conveying speed at a first conveying speed, which is slower than a second conveying speed, and sets the temperature of the first rotating body at a first temperature, which is lower than a second temperature, in the long grain feed mode; and wherein the control unit sets the conveying speed at the second conveying speed and sets the temperature of the first rotating body at the second temperature in the short grain feed mode.

9. The image heating apparatus according to claim 8, wherein the control unit executes a product quality prioritizing mode of prioritizing the quality of an image fixed on a recording sheet and a folding prioritizing mode of prioritizing foldability of a recording sheet on which an image is fixed; and wherein the long grain feed mode is the product quality prioritizing mode, and the short grain feed mode is the folding prioritizing mode.

10. An image forming apparatus comprising:

an image forming portion configured to form a toner image on a paper;

a first rotatable member configured to heat a toner image on the paper at a nip portion;

a second rotatable member configured to form the nip portion cooperatively with said first rotatable member;

a heating portion configured to heat said first rotatable member;

a detecting portion configured to detect a temperature of said first rotatable member;

a controlling portion configured to control said heating portion so that the temperature of said first rotatable member is maintained at a target temperature based on an output of said detecting portion;

an executing portion configured to execute one of plural image forming modes among (i) a first mode in which a first paper having a predetermined basis weight and having grain direction substantially orthogonal to a conveying direction of the paper, is subject to an image forming process and (ii) a second mode in which a second paper having the predetermined basis weight and having grain direction substantially in parallel with the conveying direction is subject to the image forming process; and a setting portion configured to set the target temperature and the pressure between said first rotatable member and said second rotatable member based on the image forming mode which is to be executed, wherein the target temperature in the first mode is higher than the target temperature in the second mode, and the pressure in the first mode is lower than the pressure in the second mode.

11. The image forming apparatus according to claim 10, wherein the difference between the width of the end portion of the nip portion and of the width of a central portion of the nip portion in the second mode in the conveying direction is larger than that in the first mode.

12. The image forming apparatus according to claim 11, wherein the difference in the first mode is substantially zero.

13. The image forming apparatus according to claim 10, further comprising an operating portion operable by an operator to designate one of the image forming modes among the first mode and the second mode, wherein said executing portion executes the image forming mode designated in the operating portion.

14. The image forming apparatus according to claim 13, said operating portion displays a key for designating the image forming mode.

15. An image forming apparatus comprising:

an image forming portion configured to form a toner image on a paper;

a fixing portion configured to fix the toner image onto the paper;

an operating portion operable by an operator to designate one of plural image forming modes among (i) a first mode in which a first paper having a predetermined basis weight and having grain direction substantially orthogonal to a conveying direction of the paper is subject to an image forming process and (ii) a second mode in which a second paper having the predetermined basis weight and having grain direction substantially in parallel with the conveying direction is subject to the image forming process; and a setting portion configured to set a fixing condition of the fixing portion based on the image forming mode designated in said operating portion, wherein the fixing condition in the first mode is different from the fixing condition in the second mode.

16. The image forming apparatus according to claim 15, wherein the fixing condition includes a target temperature of said first rotatable member and a pressure between said first rotatable member and said second rotatable member, and wherein the target temperature in the first mode is higher than the target temperature in the second mode, and the pressure in the first mode is lower than the pressure in the second mode.

17. The image heating apparatus according to claim 16, wherein the difference between the width of a central portion of the nip portion and the width of end portion of the nip portion in the second mode in the conveying direction is larger than that in the first mode.

18. The image heating apparatus according to claim 17, wherein the difference in the first mode is substantially zero.

19. The image forming apparatus according to claim 15, wherein the fixing condition includes a target temperature of said first rotatable member and a peripheral speed of said first rotatable member, and wherein the target temperature in the first mode is higher than the target temperature in the second mode, and the peripheral speed in the first mode is faster than the peripheral speed in the second mode.

20. The image forming apparatus according to claim 15, said operating portion displays a key for designating the image forming mode.

* * * * *